US009453300B2

(12) United States Patent
Hettinger et al.

(10) Patent No.: US 9,453,300 B2
(45) Date of Patent: Sep. 27, 2016

(54) WASHING MACHINE APPLIANCES AND METHODS FOR OPERATING THE SAME

(71) Applicant: General Electric Company, Schenectady, NY (US)

(72) Inventors: Stephen Edward Hettinger, Louisville, KY (US); Troy Marshall Wright, Louisville, KY (US)

(73) Assignee: Haier US Appliance Soultions, Inc., Wilmington, DE (US)

( * ) Notice: Subject to any disclaimer, the term of this patent is extended or adjusted under 35 U.S.C. 154(b) by 179 days.

(21) Appl. No.: 14/190,442

(22) Filed: Feb. 26, 2014

(65) Prior Publication Data

US 2015/0240409 A1 Aug. 27, 2015

(51) Int. Cl.
*D06F 39/08* (2006.01)
*D06F 35/00* (2006.01)

(52) U.S. Cl.
CPC ..... *D06F 39/088* (2013.01); *D06F 35/006* (2013.01)

(58) Field of Classification Search
CPC ..... D06F 39/088
See application file for complete search history.

(56) References Cited

U.S. PATENT DOCUMENTS 7,017,217 B2 3/2006 Johanski et al.
2013/0145562 A1 6/2013 Lee et al.

FOREIGN PATENT DOCUMENTS

DE 4116673 11/1992

*Primary Examiner* — Jason Ko
(74) *Attorney, Agent, or Firm* — Dority & Manning, P.A.

(57) ABSTRACT

Washing machine appliances and methods for operating washing machine appliances are provided. A washing machine appliance has a tub and a basket rotatably mounted within the tub, the basket defining a chamber for receipt of articles for washing. A method includes flowing a first volume of water from an external water source into the tub, agitating the articles within the tub, and, during the agitating step, flowing a second volume of water from the external water source into the tub.

12 Claims, 4 Drawing Sheets

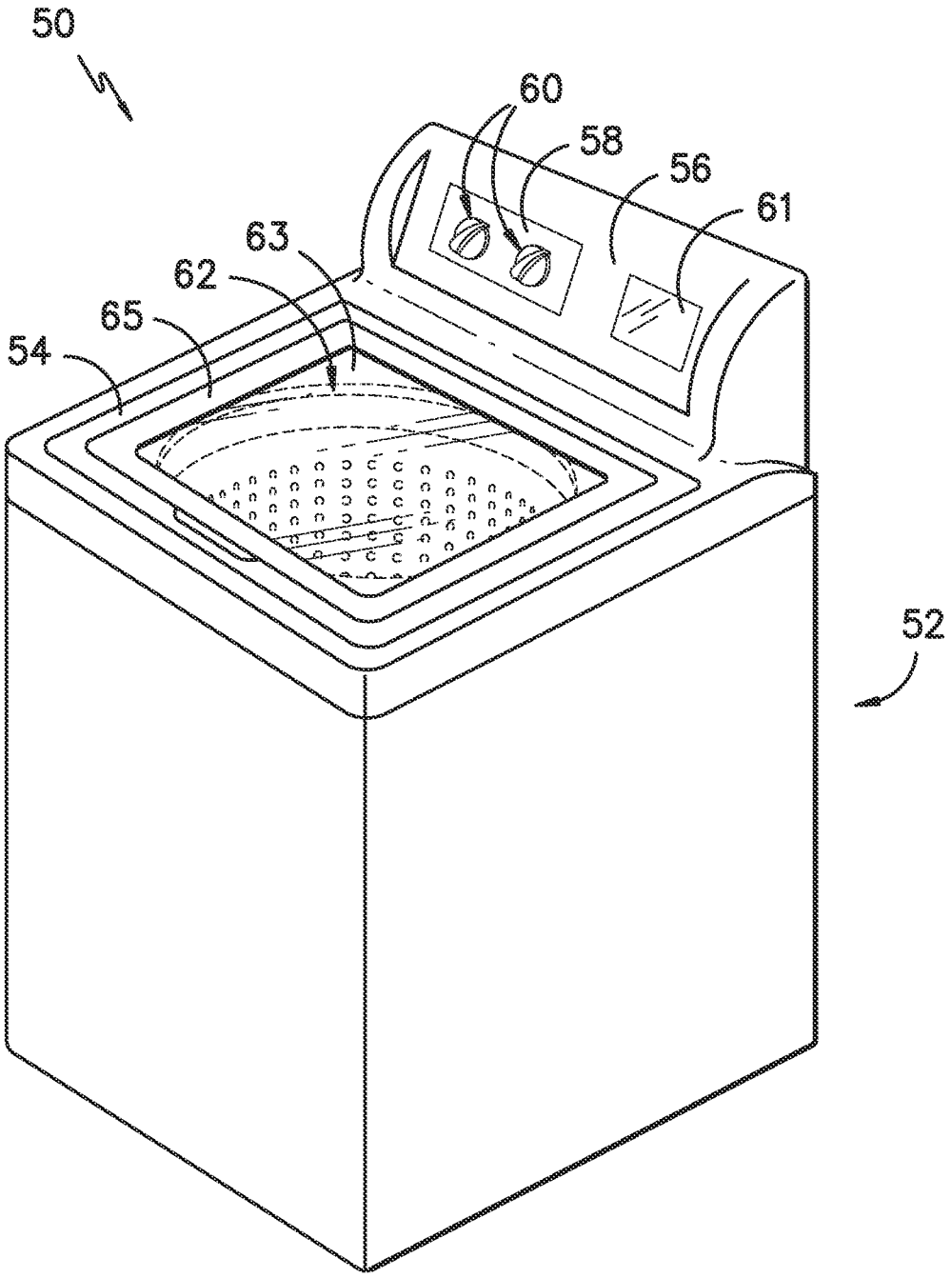
FIG. —1—

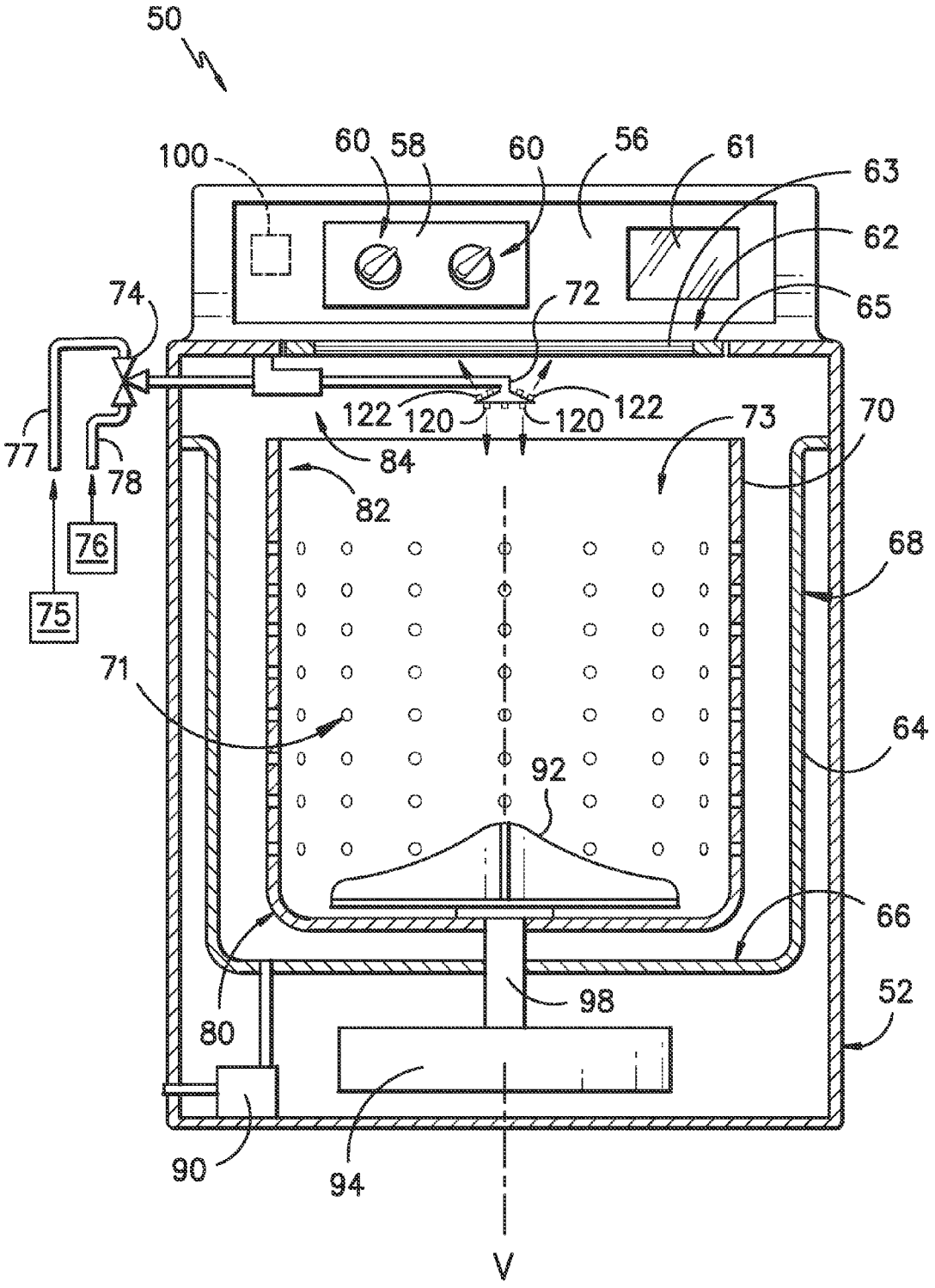
FIG. —2—

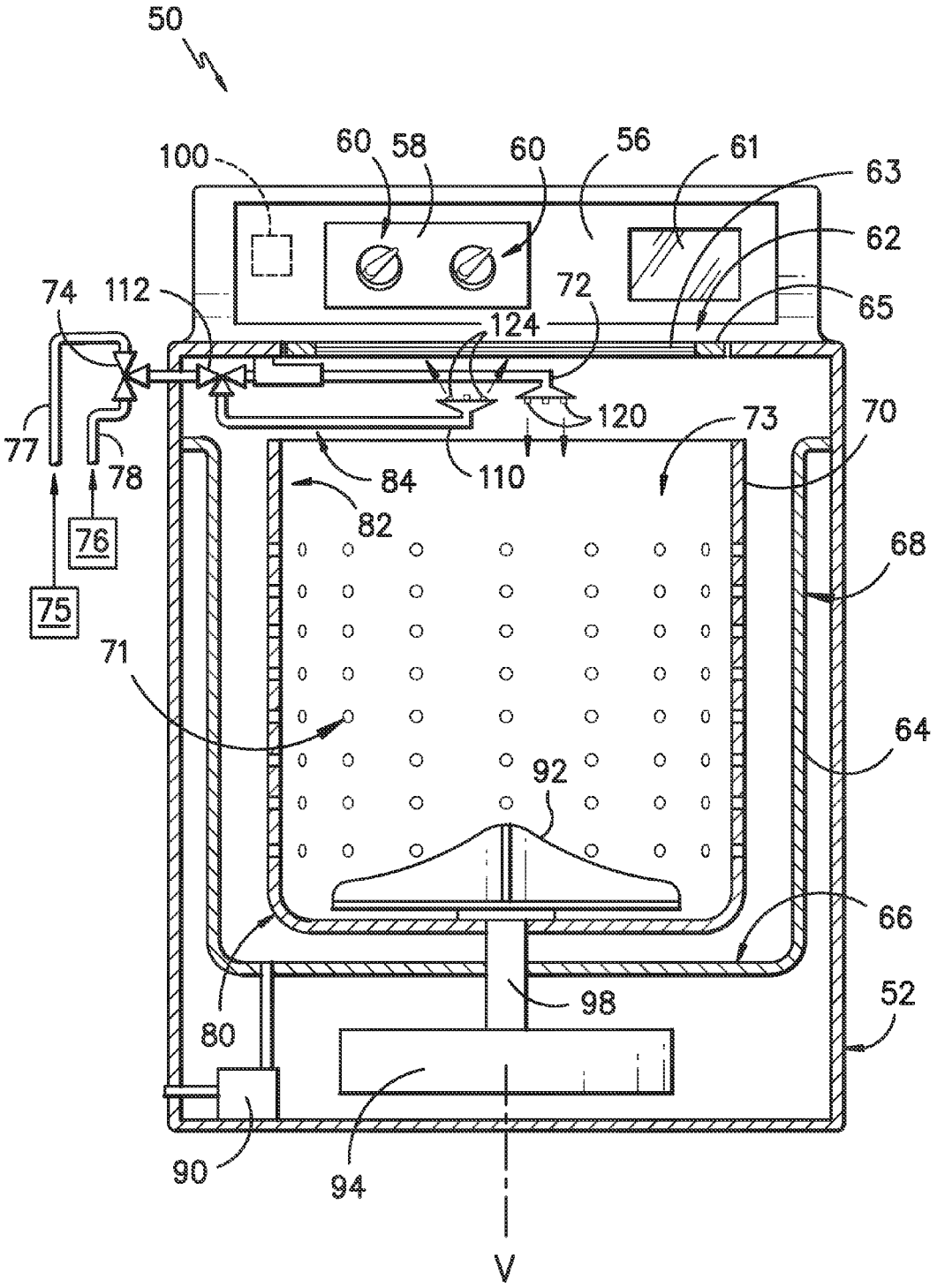
FIG. —3—

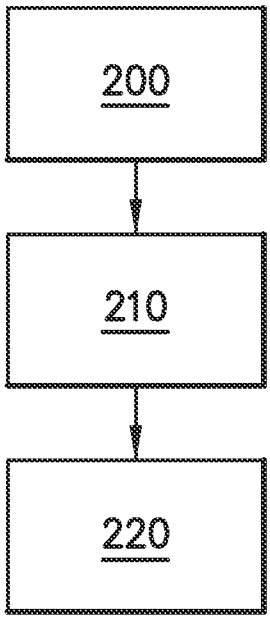
FIG. —4—

WASHING MACHINE APPLIANCES AND METHODS FOR OPERATING THE SAME

FIELD OF THE INVENTION

The present subject matter relates generally to washing machine appliances and methods for operating washing machine appliances.

BACKGROUND OF THE INVENTION

Washing machine appliances generally include a tub for containing wash fluid, e.g., water and detergent, bleach and/or other wash additives. A basket is rotatably mounted within the tub and defines a wash chamber for receipt of articles for washing. During operation of such washing machine appliances, wash fluid is directed into the tub and onto articles within the wash chamber of the basket. The basket or an agitation element can rotate at various speeds to agitate articles within the wash chamber in the wash fluid, to wring wash fluid from articles within the wash chamber, etc.

Recently, washing machine appliances which utilize impellers have gained popularity. Many of these washing machine appliances are termed "high efficiency" appliances. In particular, these appliances utilize relatively less water than traditional washing machine appliances.

In some cases, modern washing machine appliances include lids having transparent portions which allow users to see into the appliances during operation thereof. Users of impeller-based and/or high efficiency washing machine appliances can thus view the inside of their appliances during operation, and see the lower liquid levels therein. This visualization can lead to user concern that insufficient water levels are being supplied to the washing machine appliances.

To alleviate such concerns, some currently known washing machine appliances utilize recirculation pumps to create the visual image that additional liquid is being flowed into the washing machine appliances. The recirculation pumps generally pump a portion of the liquid already in the tub therethrough, such that this liquid is re-introduced to the tub during operation. However, recirculation pumps and the associated hardware are expensive and time-consuming to install. Additionally, pump clogging and failure issues can be of concern.

Accordingly, improved washing machine appliances and methods for operating washing machine appliances are desired in the art. In particular, improved appliances and methods which include features to alleviate user concerns with respect to lower liquid levels in the washing machine appliances during operation would be advantageous.

BRIEF DESCRIPTION OF THE INVENTION

In accordance with one embodiment of the present disclosure, a method for operating a washing machine appliance is provided. The washing machine appliance has a tub and a basket rotatably mounted within the tub, the basket defining a chamber for receipt of articles for washing. The method includes flowing a first volume of water from an external water source into the tub, agitating the articles within the tub, and, during the agitating step, flowing a second volume of water from the external water source into the tub.

In accordance with another embodiment of the present disclosure, a washing machine appliance is provided. The washing machine appliance includes a tub, and a basket rotatably mounted within the tub, the basket defining a wash chamber for receipt of articles for washing. The washing machine appliance further includes a main valve in fluid communication with an external water source, a nozzle configured for flowing liquid from the valve into the tub, and a motor in mechanical communication with the basket, the motor configured for selectively agitating the articles within the tub. The washing machine appliance further includes a controller in operative communication with the valve and the motor. The controller is operable for flowing a first volume of water from an external water source into the tub, agitating the articles within the tub, and, during the agitating step, flowing a second volume of water from the external water source into the tub.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 1 provides a perspective view of a washing machine appliance according to an exemplary embodiment of the present subject matter.

FIG. 2 provides a front, section view of a washing machine appliance in accordance with one embodiment of the present disclosure;

FIG. 3 provides a front, section view of a washing machine appliance in accordance with another embodiment of the present disclosure; and FIG. 4 provides a flow chart of an exemplary method for operating a washing machine appliance according to an exemplary embodiment of the present subject matter.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view of a washing machine appliance 50 according to an exemplary embodiment of the present subject matter. As may be seen in FIG. 1, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment, a display 61 indicates selected features, a countdown timer, and/or other items of interest to machine users. A lid 62 is mounted to cover 54 and is rotatable between an open position (not shown) facilitating access to a wash tub 64 (FIGS. 2 and 3) located within cabinet 52 and a closed position (shown in FIG. 1) forming an enclosure over tub 64.

Lid 62 in exemplary embodiment includes a transparent panel 63, which may be formed of for example glass, plastic, or any other suitable material. The transparency of the panel 63 allows users to see through the panel 63, and into the tub 64 when the lid 62 is in the closed position. In some embodiments, the panel 63 may itself generally form the lid 62. In other embodiments, the lid 62 may include the panel 63 and a frame 65 surrounding and encasing the panel 63.

FIGS. 2 and 3 provide front, cross-section views of washing machine appliance 50. As may be seen in FIGS. 2 and 3, tub 64 includes a bottom wall 66 and a sidewall 68. A wash drum or wash basket 70 is rotatably mounted within tub 64. In particular, basket 70 is rotatable about a vertical axis V. Thus, washing machine appliance is generally referred to as a vertical axis washing machine appliance. Basket 70 defines a wash chamber 73 for receipt of articles for washing and extends, e.g., vertically, between a bottom portion 80 and a top portion 82. Basket 70 includes a plurality of openings or perforations 71 therein to facilitate fluid communication between an interior of basket 70 and tub 64.

A first nozzle 72 is configured for flowing a liquid into tub 64. In particular, nozzle 72 may be positioned at or adjacent top portion 82 of basket 70. Nozzle 72 may be in fluid communication with a water supply (not shown) in order to direct liquid (e.g. water) into tub 64 and/or onto articles within chamber 73 of basket 70. A main valve 74 regulates the flow of fluid through nozzle 72. For example, valve 74 can selectively adjust to a closed position in order to terminate or obstruct the flow of fluid through nozzle 72. The main valve 74 may be in fluid communication with one or more external water sources 75, 76, such as a commercial water supply and/or a water heater, respectively. Such external water sources 75, 76 may supply water to the appliance 50 through the main valve 74. A cold water conduit 77 and a hot water conduit 78 may supply cold and hot water, respectively, through valve 74. Valve 74 may further be operable to regulate the flow of hot and cold liquid, and thus the temperature of the resulting liquid flowed into tub 64, such as through the nozzle 72. An additive dispenser 84 may additionally be provided for directing a wash additive, such as detergent, bleach, liquid fabric softener, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. In some embodiments, nozzle 72 is a separate downstream component from dispenser 84. In other embodiments, nozzle 72 and dispenser 84 may be integral, with a portion of dispenser 84 serving as the nozzle 72. A pump assembly 90 (shown schematically in FIGS. 2 and 3) is located beneath tub 64 and basket 70 for gravity assisted flow to drain tub 64.

An agitation element 92, shown as an impeller in FIGS. 2 and 3, may be disposed in basket 70 to impart an oscillatory motion to articles and liquid in chamber 73 of basket 70. In various exemplary embodiments, agitation element 92 includes a single action element (i.e., oscillatory only), double action (oscillatory movement at one end, single direction rotation at the other end) or triple action (oscillatory movement plus single direction rotation at one end, singe direction rotation at the other end). As illustrated in FIGS. 2 and 3, agitation element 92 is oriented to rotate about vertical axis V. Basket 70 and agitation element 92 are driven by a motor 94, such as a pancake motor. As motor output shaft 98 is rotated, basket 70 and agitation element 92 are operated for rotatable movement within tub 64, e.g., about vertical axis V. Washing machine appliance 50 may also include a brake assembly (not shown) selectively applied or released for respectively maintaining basket 70 in a stationary position within tub 64 or for allowing basket 70 to spin within tub 64.

Operation of washing machine appliance 50 is controlled by a processing device or controller 100, that is operatively coupled to the input selectors 60 located on washing machine backsplash 56 (shown in FIG. 1) for user manipulation to select washing machine cycles and features. Controller 100 may further be operatively coupled to various other components of appliance 50, such as main valve 74, motor 94, etc. In response to user manipulation of the input selectors 60, controller 100 may operate the various components of washing machine appliance 50 to execute selected machine cycles and features.

Controller 100 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 may be in communication with controller 100 via one or more signal lines or shared communication busses.

In an illustrative embodiment, laundry items are loaded into chamber 73 of basket 70, and washing operation is initiated through operator manipulation of control input selectors 60. Tub 64 is filled with water and mixed with detergent to form a liquid or wash fluid. Main valve 74 can be opened to initiate a flow of water into tub 64 via nozzle 72, and tub 64 can be filled to the appropriate level for the amount of articles being washed. Once tub 64 is properly filled with wash fluid, the contents of the basket 70 are agitated with agitation element 92 for cleaning of articles in basket 70. More specifically, agitation element 92 is moved back and forth in an oscillatory motion.

After the agitation phase of the wash cycle is completed, tub 64 is drained. Laundry articles can then be rinsed by again adding fluid to tub 64, depending on the particulars of the cleaning cycle selected by a user, agitation element 92 may again provide agitation within basket 70. One or more spin cycles may also be used. In particular, a spin cycle may be applied after the wash cycle and/or after the rinse cycle in order to wring wash fluid from the articles being washed. During a spin cycle, basket 70 is rotated at relatively high speeds.

While described in the context of a specific embodiment of washing machine appliance 50, using the teachings disclosed herein it will be understood that washing machine appliance 50 is provided by way of example only. Other washing machine appliances having different configurations (such as horizontal-axis washing machine appliances), different appearances, and/or different features may also be utilized with the present subject matter as well.

Referring now to FIG. 3, in some embodiments, a second nozzle 110 may be utilized in the washing machine appliance 50. Second nozzle 110 may additionally be utilized to flow water therethrough into the tub 64. For example, a secondary valve 112, which may be in communication with controller 100, may be positioned between main valve 74 and first nozzle 72. The secondary valve 112 may operate to divert the flow of water from the main valve 74 through the secondary valve 112 to the second nozzle 110. The water may then flow from the second nozzle 110 into the tub 64. Alternatively, main valve 74 may be operable to flow water to the second nozzle 110, or other suitable apparatus may be utilized to flow water to the second nozzle 110.

As illustrated, the first nozzle 72 and second nozzle 110 may include apertures through which water may be exhausted into the tub 64. For example, first nozzle 72 may in some embodiments include apertures 120 through which a first volume of water may be flowed. As discussed herein, the first volume is typically a majority of the water to be introduced into the tub 64 before and for use during agitation of articles within the tub 64. Such apertures 120 are typically oriented towards the tub 64, such as generally parallel to the vertical axis V, such that water exhausted therefrom is flowed generally towards the tub 64. It should be understood that apertures 120 may be oriented in any suitable direction.

As illustrated in FIG. 2, in some embodiments, first nozzle 72 may further include apertures 122 through which a second volume of water may be flowed. As discussed herein, the second volume of water is typically a minority of the water to be introduced into the tub 64 for use during agitation of articles within the tub 64, and may be flowed to the tub 64 during such agitation. Flowing of such water during agitation advantageously may provide to users of the appliance 50 the visual image that an increased amount of water is being flowed into the tub 64, thus allaying fears that insufficient water is being supplied. Such apertures 122 may in exemplary embodiments be oriented such that the flow streams of water flowed therethrough may be visible through the lid 62, such as through the transparent panel 63 thereof. The apertures 122 themselves may or may not be visible through the lid 62 and transparent panel 63. Additionally or alternatively, the second volume of water may in exemplary embodiments be exhausted, such as from nozzle 72, generally in a direction generally transverse to the vertical axis V. In these embodiments, the apertures 122 may be oriented such that the water exhausted therefrom, if flowed in a straight line from the aperture in the direction of exhaust, would flow generally along a transverse axis across the tub 64, such as from the back of the tub 64 to the front or from one side to the other. Such orientation of the apertures advantageously facilitates the visual image to consumers of increased water flow from the nozzle 72.

Alternatively, as illustrated in FIG. 2, second nozzle 110 may include apertures 124 through which the second volume of water may be flowed. Such apertures 124 may in exemplary embodiments be oriented such that the apertures 124, and thus the water flowed therethrough, may be visible through the lid 62, such as through the transparent panel 63 thereof. Additionally or alternatively, the second volume of water may in exemplary embodiments be exhausted, such as from nozzle 110, generally towards the lid 62. In these embodiments, the apertures 124 may be oriented such that the water exhausted therefrom, if flowed in a straight line from the aperture in the direction of exhaust, would contact the lid 62. Such orientation of the apertures advantageously facilitates the visual image to consumers of increased water flow from the nozzle 110.

It should be understood that apertures according to the present disclosure may be tubes extending from the nozzles 72, 110, as illustrated, or simply holes defined in the nozzles 72, 110, or any other suitable openings through which water may flow.

Referring now to FIGS. 2 and 3, as well as FIG. 4, the present disclosure is further directed to methods for operating washing machine appliances 50 which advantageously create the image (or illusion) of increased water flow during the wash cycle. Such image is facilitated by the use of a first volume of water to initially fill the tub 64 and a second volume of water flowed into the tub 64 during agitation of articles in the tub 64.

Accordingly, a method according to the present disclosure may include the step 200 of flowing a first volume of water into the tub 64. The first volume of water may be obtained from one or more external water sources 75, 76. Further, in exemplary embodiments, the first volume of water is less than a predetermined volume of liquid for the tub 64. The predetermined volume of liquid for the tub 64 of a washing machine appliance 50 is generally a rated volume of liquid that the appliance 50 is constructed to hold. In particular, such predetermined volume can be based on government standard, such as "green" or "high efficiency" standards.

A method according to the present disclosure may further include, for example, the step 210 of agitating the articles within the tub 64. For example, agitation element 92 may be operated to agitate the articles, as discussed above.

A method according to the present disclosure may further include, for example, the step 220 of flowing a second volume of water into the tub 64. Such step 220 may occur, for example, during the step 210 of agitating the articles within the tub 64. The first second volume of water may be obtained from one or more external water sources 75, 76.

Flowing of the second volume of water into the tub 64 advantageously provides the appearance that an increased amount of water is being flowed into the tub 64, thus improving user reactions when viewing operation of the appliance 50. However, in exemplary advantageous embodiments, the second volume of water simply combines with the first volume of water to approximately meet the desired and necessary water levels for operation of the washing machine appliance 50, without the actual addition of a substantial amount of extra water. For example, in some embodiments, a sum of the first volume and the second volume is equal to between approximately 90% and approximately 120% of the predetermined total volume of liquid for the tub. In alternative embodiments, however, the sum of the first volume and the second volume may be substantially greater than the predetermined total volume of liquid for the tub (i.e. greater than approximately 120% of the predetermined total volume of liquid for the tub). For example, in some embodiments, a sum of the first volume and the second volume is equal to between approximately 110% and approximately 180% of the predetermined total volume of liquid for the tub. This may provide both the appearance and the reality of an increased amount of water being flowed into the tub.

In some embodiments, the second volume is flowed into the tub 64 intermittently during the agitating step 210. Such intermittent flow can have any suitable pattern, which in exemplary embodiments may be designed to create the appearance of increased water flow into the tub 64. Alternatively, the second volume may be flowed into the tub 64 continuously during the agitating step 210.

Second volume in exemplary embodiments is typically less that the first volume. For example, the second volume may be less than or equal to approximately 40%, less than or equal to approximately 30%, or less than or equal to approximately 20% of an overall volume of liquid flowed into the tub 64. The overall volume may be approximately equal to, less than, or greater than the predetermined total volume of liquid for the tub. Further, in exemplary embodiments, the second volume may be flowed into the tub 64 at a relatively low flow rate, in order to facilitate the use of a small amount of water over a large period of time during agitation. For example, the second volume may be flowed at a flow rate of less than or equal to approximately 1.5 gallons per minute, such as between approximately 1.5 gallons per minute and approximately 0.5 gallons per minute.

As discussed, in some embodiments, the first volume and the second volume are both flowed through the first nozzle 72, as illustrated in FIG. 2. In other embodiments, the first volume may be flowed through the first nozzle 72, while the second volume is flowed through the second nozzle 110. Flow through the nozzles 72 and, optionally, 110 according to the present disclosure may facilitate the appearance of an increased water level flowing into the tub 64 during appliance 50 operation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:
- a tub;
- a basket rotatably mounted within the tub, the basket defining a wash chamber for receipt of articles for washing;
- a main valve hi fluid communication wit h an external water source;
- a nozzle configured for flowing water from the valve into the tub, the nozzle comprising a first aperture oriented in a first direction and a second aperture oriented in a second direction, the second direction generally away from the first direction;
- a motor in mechanical communication with the basket, the motor configured for selectively rotating the basket within the tub;
- a lid, the lid comprising a transparent panel; and
- a controller in operative communication with the valve and the motor, the controller operable for:
  - flowing a first volume of water from an external water source through the first aperture into the tub in the first direction;
  - agitating the articles within the tub; and
  - during the agitating step, flowing a second volume of water from the external water source through the second aperture into the tub in the second direction, wherein the second direction is oriented such that flow streams produced by the second aperture are visible through the transparent panel.

2. The washing machine appliance of claim 1, wherein the second direction is generally transverse to a vertical axis of the basket.

3. The washing machine appliance of claim 1, wherein the second volume is flowed intermittently.

4. The washing machine appliance of claim 1, wherein the second volume is flowed at a flow rate of less than or equal to approximately 1.5 gallons per minute.

5. The washing machine appliance of claim 1, wherein the first volume is less than a predetermined total volume of liquid for the tub.

6. The washing machine appliance of claim 1, wherein a sum of the first volume and the second volume is equal to between approximately 90% and approximately 120% of a predetermined total volume of liquid for the tub.

7. The washing machine appliance of claim 1, wherein a sum of the first volume and the second volume is equal to between approximately 110% and approximately 180% of a predetermined total volume of liquid for the tub.

8. The washing machine appliance of claim 1, wherein the first volume and the second volume are flowed through the nozzle.

9. A washing machine appliance, comprising:
- a tub;
- a basket rotatably mounted within the tub, the basket defining a wash chamber for receipt of articles for washing;
- a main valve in fluid communication with an external water source;
- a first nozzle configured for flowing water from the valve into the tub;
- at least one aperture defined in the first nozzle and oriented in a first direction;
- a second nozzle configured for flowing water from the valve into the tub;
- at least one aperture defined in the second nozzle and oriented in a second direction, the second direction generally away from the first direction;
- a motor in mechanical communication with the basket, the motor configured for selectively rotating the basket within the tub;
- a lid, the lid comprising a transparent panel; and
- a controller in operative communication with the valve and the motor, the controller operable for:
  - flowing a first volume of water from an external water source into the tub;
  - agitating the articles within the tub; and
  - during the agitating step, flowing a second volume of water form the external water source into the tub, wherein the first volume is flowed though the first nozzle in the first direction and the second volume is flowed through the second nozzle in the second direction, and wherein the second direction is oriented such that the flow streams produced by the second nozzle are visible through the transparent panel.

10. The washing machine appliance of claim 1, wherein the second direction is generally towards the lid.

11. The washing machine appliance of claim 8, wherein the second direction is generally transverse to a vertical axis of the basket.

12. The washing machine appliance of claim 8, wherein the second direction is generally towards the lid.

* * * * *